US009281605B2

(12) United States Patent
Boemmel et al.

(10) Patent No.: US 9,281,605 B2
(45) Date of Patent: Mar. 8, 2016

(54) PLUG-AND-SOCKET CONNECTOR ARRANGEMENT WITH FIRST AND SECOND PLUGS AND MATING PLUG

(75) Inventors: Christian Otto Boemmel, Langen (DE); Rolf Jetter, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 88 days.

(21) Appl. No.: 13/513,541

(22) PCT Filed: Nov. 23, 2010

(86) PCT No.: PCT/EP2010/068043

§ 371 (c)(1),
(2), (4) Date: Jun. 1, 2012

(87) PCT Pub. No.: WO2011/067140

PCT Pub. Date: Jun. 9, 2011

(65) Prior Publication Data

US 2012/0238123 A1 Sep. 20, 2012

(30) Foreign Application Priority Data

Dec. 2, 2009 (DE) ..... 10 2009 056 517

(51) Int. Cl.
*H01R 13/62* (2006.01)
*H01R 13/516* (2006.01)

(52) U.S. Cl.
CPC ..... *H01R 13/516* (2013.01); *H01R 2201/26* (2013.01)

(58) Field of Classification Search
CPC ..... H01R 13/516; H01R 2201/26
USPC ..... 439/393–417, 701
See application file for complete search history.

(56) References Cited

U.S. PATENT DOCUMENTS 5,151,048 A * 9/1992 Sato ..... 439/357
5,322,448 A 6/1994 Hahn (Continued)

FOREIGN PATENT DOCUMENTS

EP 0549371 A2 6/1993
EP 1560298 A1 8/2005

OTHER PUBLICATIONS

International Preliminary Report on Patentability issued by the International Bureau of WIPO, dated Jun. 5, 2012, for related International Application No. PCT/EP2010/068043; 9 pages.

(Continued)

*Primary Examiner* — Briggitte R Hammond
(74) *Attorney, Agent, or Firm* — Faegre Baker Daniels LLP

(57) ABSTRACT

The invention relates to a plug (1), with a first plug-and-socket connector (5) and at least a second plug-and-socket connector (4) in which the first plug-and-socket connector (5) can be received, and with a surrounding housing (6) in which the second plug-and-socket connector (4) can be received non-displaceably in at least one securing direction (A). Furthermore, the invention relates to a mating plug (2) with a first mating connector (7) and at least a second mating connector (2*a*), in which the first mating connector (7) can be received. In order to facilitate the assembly of a plug-and-socket connector arrangement (3), provision is made according to the invention for the surrounding housing (6) to have a securing member (17, 18) which is designed to be able to be brought into engagement with the second plug-and-socket connector (4) and the first plug-and-socket connector (5) received in the second plug-and-socket connector (4), and by means of which the first (5) and second (4) plug-and-socket connectors can be fixed relative to the surrounding housing (6). For a mating plug (2), the object is achieved in that the first mating connector (7) is designed to be able to be constructed in modular fashion from a receiving module (7*e*) and a connection module (7*f*).

27 Claims, 7 Drawing Sheets

(56) References Cited

U.S. PATENT DOCUMENTS

| | | | | |
|---|---|---|---|---|
| 5,344,347 | A * | 9/1994 | Inoue et al. | 439/701 |
| 5,494,450 | A | 2/1996 | Kirsch et al. | |
| 5,564,953 | A * | 10/1996 | Endo et al. | 439/701 |
| 5,913,703 | A * | 6/1999 | Suzuki et al. | 439/701 |
| 6,582,256 | B2 * | 6/2003 | Sakurai et al. | 439/701 |
| 6,786,777 | B2 * | 9/2004 | Sakatani | 439/677 |
| 7,025,610 | B2 | 4/2006 | Demuth | |
| 7,108,566 | B2 * | 9/2006 | Kressmann et al. | 439/701 |
| 7,347,710 | B2 * | 3/2008 | Ohtaka et al. | 439/352 |
| 7,682,189 | B2 * | 3/2010 | Yamaguchi et al. | 439/557 |
| 8,142,232 | B1 * | 3/2012 | Song et al. | 439/701 |
| 2002/0106942 | A1 | 8/2002 | Sakurai et al. | |
| 2008/0297988 | A1 | 12/2008 | Chau | |
| 2010/0136847 | A1 * | 6/2010 | Hung et al. | 439/701 |

OTHER PUBLICATIONS

International Search Report and Written Opinion issued by the European Patent Office, dated Feb. 21, 2011, for related International Application No. PCT/EP2010/068043; 13 pages.

* cited by examiner

PLUG-AND-SOCKET CONNECTOR ARRANGEMENT WITH FIRST AND SECOND PLUGS AND MATING PLUG

The invention relates to a plug with a first plug-and-socket connector, preferably standardised in accordance with a first standard, and a second plug-and-socket connector, preferably standardised in accordance with a second standard, in which the first plug-and-socket connector can be received, and with a surrounding housing in which the second plug-and-socket connector can be received non-displaceably in at least one securing direction. Furthermore, the invention relates to a mating plug for a plug of the type mentioned above, with a first mating connector, preferably standardised in accordance with a first standard, and a second mating connector, preferably standardised in accordance with a second standard, in which the first mating connector can be received, and also a plug-and-socket connector arrangement with a plug and a mating plug.

Plugs and mating plugs of the type mentioned above and plug-and-socket connector arrangements having such plugs and mating plugs are known in particular from applications in automotive engineering. Vibrations which occur in motor vehicles during the entire life cycle of the motor vehicle, or forces which in the event of repairs or accidents act on wiring harnesses in the electrical system of the motor vehicle may result in unintentional loosening of plug-and-socket connections.

In order to increase the reliability of plug-and-socket connectors and plug-and-socket connector arrangements, different fastening means, for example screws and latch connections, are used which are intended to ensure secure fastening of plug-and-socket connectors to mating connectors. For plugs of the type mentioned above, which comprise at least a second plug-and-socket connector in addition to a first plug-and-socket connector, a plurality of fastening means are necessary.

One disadvantage of the conventionally used plugs, mating plugs and plug-and-socket connector arrangements of the type mentioned above is the expensive assembly thereof. The fastening means to be assembled for each plug-and-socket connector may be assembled incorrectly or may loosen after they have been assembled, so that the electrical connection between the plug-and-socket connectors is lost. The probability of the plug-and-socket connectors failing is thus increased by with an increasing number of fastening means [sic].

Consequently, it is an object of the invention to provide a plug-and-socket connector arrangement of the type mentioned above, the assembly of which is simplified.

This object is achieved according to the invention in that the surrounding housing has a securing member which is designed to be able to be brought into engagement with the second plug-and-socket connector and the first plug-and-socket connector received in the second plug-and-socket connector, and by means of which the first and second plug-and-socket connectors can be fixed relative to the surrounding housing.

The assembly of the plug is distinctly simplified in that both the first and the second plug-and-socket connector can be fixed by only one component, namely the surrounding housing. Preferably the surrounding housing, once the first plug-and-socket connector has been inserted into the second plug-and-socket connector, is pushed in one assembly step on to the second plug-and-socket connector and thus in one assembly step a force-conducting connection between the first and second plug-and-socket connector and the surrounding housing is brought about.

The plug according to the invention can be developed further by various embodiments, which are independent of each other and each of which are advantageous in themselves. These configurations and the advantages associated with the configurations in each case will be briefly discussed below.

According to a first advantageous configuration, the first plug-and-socket connector may have a first plug-and-socket connector face and the second plug-and-socket connector a second plug-and-socket connector face. The first plug-and-socket connector face and the second plug-and-socket connector face may be parts of a common plug face or jointly form a plug face. The plug face can consequently be assembled from the first plug-and-socket connector face and the second plug-and-socket connector face. Correspondingly, a first mating connector face and a second mating connector face may be parts of a mating connector face or jointly form a mating connector face. In order, during an insertion operation in which the plug is plugged into a mating plug, to connect the first plug-and-socket connector to a first mating connector and at the same time the second plug-and-socket connector to a second mating connector in electrically conductive or signal-transmitting manner, the first plug-and-socket connector face and/or mating connector face and the second plug-and-socket connector face and/or mating connector face may be arranged on a common plane extending transversely to the direction of insertion.

The plug face and the plug-and-socket connector faces may form interfaces comprising contact pins and/or contact bushes, which interfaces may be designed to be able to be connected to mating connector faces and/or one mating plug face. In order, when connecting a plug to a mating plug, to avoid incorrect association for example of contact pins of the plug with contact bushes of the mating plug, the plug-and-socket connector faces and mating connector faces may be provided with coding elements and/or guides which in the event of contact pins and contact bushes which are not aligned suitably relative to one another block the plug face and mating plug face from sliding into one another. The coding elements may for example be formed by projections on the plug face or mating plug face which extend transversely to a direction of insertion, and which are flush in the direction of insertion with cutouts or openings which likewise form coding elements.

According to a further advantageous configuration of the plug, the securing member can block a movement of the second plug-and-socket connector and/or of the first plug-and-socket connector in the surrounding housing in and/or counter to a direction of insertion. Thus unintentional loosening of the plug-in connection in the direction of insertion is prevented in a connection of the plug with a correspondingly designed mating plug which is preferably brought about via the surrounding housing. The securing direction may thus correspond to the direction of insertion.

In a further advantageous configuration, the securing member may be designed as a positive-locking element which at least in the securing direction is designed to be able to be brought into engagement in positive manner with the first plug-and-socket connector and/or the second plug-and-socket connector. The positive-locking element may be designed as a projection, cutout or opening in the surrounding housing. The securing member, in an advantageous configuration, may penetrate, at least in sections, an internal-plug receptacle of the second plug-and-socket connector in order to receive the first plug-and-socket connector substantially transversely to the securing direction and spaced apart from a plug-and-socket connector face of the second plug-and-socket connector. The first and the second plug-and-socket connector may be connected in positive manner to the surrounding housing by the positive-locking element via the securing member.

Preferably the securing member is formed by a bar extending substantially transversely to the securing direction and projecting into a receiving shaft of the surrounding housing. The bar may extend in an assembly direction, in which the second plug-and-socket connector is introduced into the receiving shaft. Preferably the second plug-and-socket connector is provided with an opening into which the securing member projects in the assembled state of the plug. The first plug-and-socket connector may be equipped with a receptacle which may for example be designed as a holding projection, and in the assembled state of the plug adjoins the securing member which penetrates the second plug-and-socket connector.

In order to fix the first and/or the second plug-and-socket connector on at least two sides relative to the surrounding housing, the surrounding housing may advantageously be provided with two securing members which are arranged on opposing sides of the receiving shaft. Correspondingly, the second plug-and-socket connector may be provided on opposing outer sides with openings and/or projections for receiving the securing members arranged opposite each other.

According to a further advantageous configuration of the plug, the first plug-and-socket connector may have a holding member which lies against the securing member counter to the securing direction. The holding member may be designed as a holding projection or as a holding groove which is engaged with the securing member in the assembled state of the plug. In order to permit securing of the first plug-and-socket connector in two securing directions, a plurality of holding members may be provided. For example, two holding projections may be provided which form a holding groove for receiving a securing member. Alternatively, a recess may be formed in a housing of the first plug-and-socket connector, into which recess the at least one securing member can be inserted when the first plug-and-socket connector is received in the second plug-and-socket connector.

According to a further advantageous embodiment of the plug, the first plug-and-socket connector and/or the second plug-and-socket connector may be provided with a guide member by means of which the first plug-and-socket connector can be guided into a final assembly position in the direction of insertion. Thus the positioning of the first plug-and-socket connector in the second plug-and-socket connector is simplified for alignment of the plug-and-socket connector face of the first plug-and-socket connector relative to the plug-and-socket connector face of the second plug-and-socket connector or of the holding member of the first plug-and-socket connector relative to the securing member. In the final assembly position, the plug-and-socket connector faces of the first and of the second plug-and-socket connector are preferably aligned relative to one another, so that the contacts of the plug are contacted simultaneously upon the joining of a plug-and-socket connector arrangement consisting of a plug and a mating plug. The plug-and-socket connector faces may preferably be flush with one another.

The second plug-and-socket connector may have an internal-plug receptacle for receiving the first plug-and-socket connector. In order to hold or fix the first plug-and-socket connector in the second plug-and-socket connector at least during the assembly of the plug, the outer walls of the first plug-and-socket connector in the assembled state may lie in a frictional connection against the inner walls of the internal-plug receptacle. Alternatively or additionally, positive-locking elements may be provided on the first plug-and-socket connector and in the internal-plug receptacle, which elements permit a positive connection of the first plug-and-socket connector to the second plug-and-socket connector. For example, the plug may comprise a latch connection, in which a latch arranged on the first plug-and-socket connector engages in a mating latch arranged on the internal-plug receptacle of the second plug-and-socket connector.

In order to fasten the second plug-and-socket connector to the surrounding housing, the second plug-and-socket connector may have a latching means by means of which said connector can be latched in the surrounding housing. Preferably a latch designed as a latch projection is arranged on the second plug-and-socket connector, which latch in a predetermined position corresponding to a final assembly position can be engaged in a mating latch of the surrounding housing which is designed as a cutout or opening. The latch may be arranged on an elastically deflectable latch tab, by which the latch can be deflected substantially in a direction facing away from the mating latch.

For a mating plug of the type mentioned above, the object is achieved according to the invention in a configuration which is also advantageous on its own in that the first mating connector is designed to be able to be constructed in modular fashion from a receiving module and a connection module. Whereas the receiving module serves for receiving the first plug-and-socket connector, the first mating connector is connected via the connection module to the vehicle electrical system or vehicle electronics. The receiving module can be adapted to the dimensions of the housing of the mating plug and/or of the first plug-and-socket connector. Upon assembly of the mating plug, thus the first mating connector can be adapted to the specification of the first plug-and-socket connector, for example to the dimensions thereof, by a selection of a receiving module adapted to the first plug-and-socket connector.

The connection module on the other hand permits adaptation of the first mating connector to specifications of the mating plug, for example the dimensions of the mating-plug housing, and also adaptation to the vehicle electrical system or vehicle electronics which are to be connected, for example the dimensions of a printed circuit board which is to be connected to the mating plug. The mating plug may have a plurality of contact pins which at a first end form contacts arranged on the plug face and at a second end form contacts for connecting the mating plug to the vehicle electrical system or vehicle electronics. The connection module may preferably be adapted to the positioning of the contacts for the connection of the mating plug, so that contacts surrounded by the connection module form a preferably standardised connection interface of the mating plug with the further connection contacts of the mating plug.

According to a further advantageous configuration of the mating plug, the receiving module and the connection module of the first mating connector may each have an electrically insulating insulating member with at least one receiving shaft for receiving a contact pin, the receiving shaft of the receiving module and the receiving shaft of the connection module in the assembled state together forming a continuous receptacle for a contact pin.

In a further advantageous configuration of the mating plug, the receiving module and/or the connection module of the first mating connector can be able to be connected in a frictional connection to the contact pin via at least one contact pin which can be received in the cutouts. Thus the contact pins of the first mating connector may serve as fastening elements, without additional parts being required for the assembly of the first mating connector.

The first plug-and-socket connector can be designed for connecting data-transmitting signal lines. In order to permit reliable, interference-free transmission of signals, the receiving module and the connection module may each have an electromagnetic screen, which adjoin each other in the assembled state of the first mating connector, thus are connected together in electrically conductive manner and form a virtually completely closed electromagnetic screen of the first mating connector. The electromagnetic screen of the connection module may comprise an electrical contact for connecting the screen to an earth conductor.

For reliable fastening of the surrounding housing of the plug in the mating plug, the surrounding housing may have a latching means, by means of which it can be latched in the mating plug.

The invention will be explained by way of example below using an example of embodiment with reference to the drawings. Therein, the embodiment described merely represents one possible configuration which can be modified for the respective application. Individual features which are advantageous per se may be added or omitted in accordance with the above description of the advantageous configurations in the embodiment described.

Figure 1:
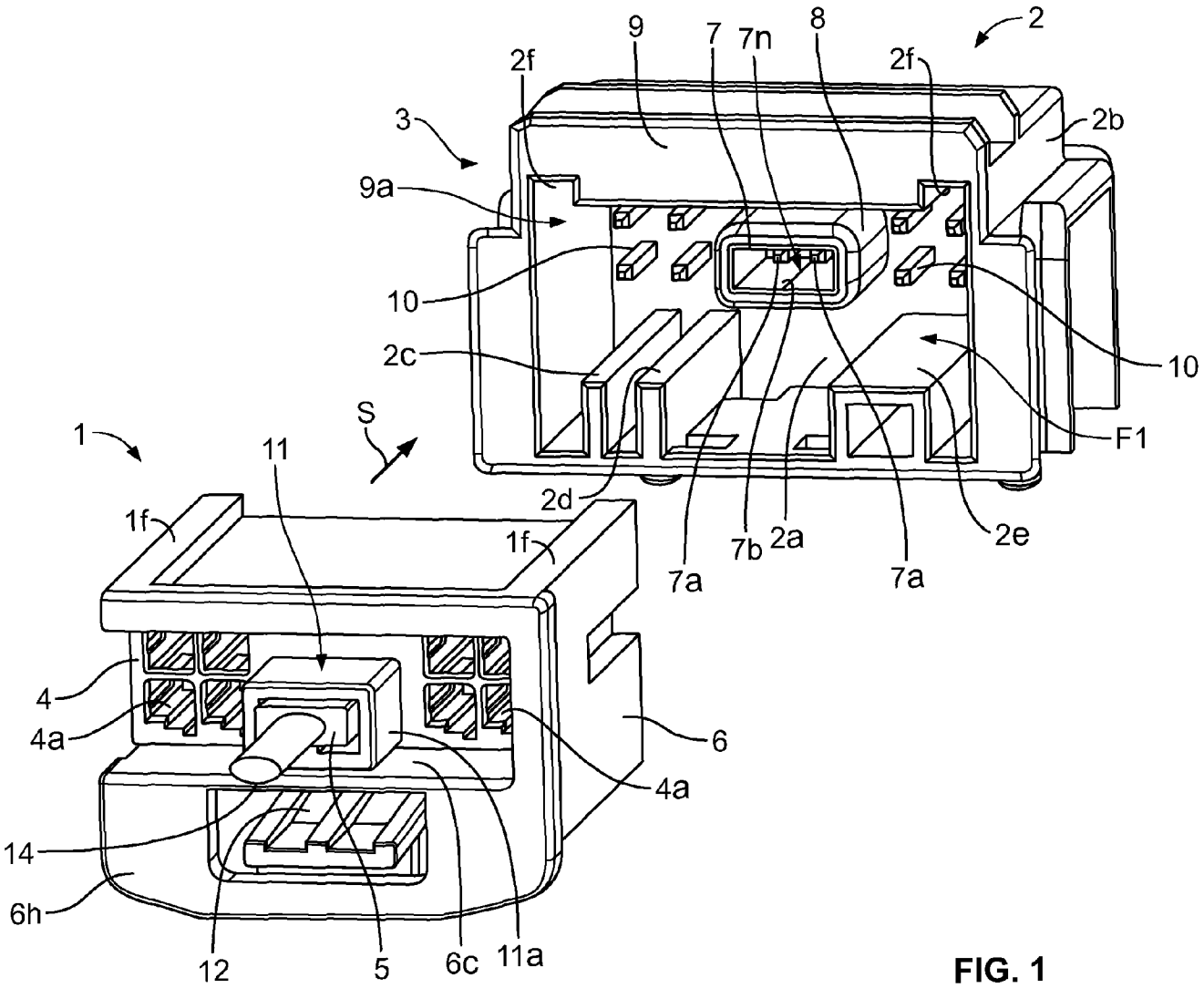
FIG. 1 shows a diagrammatic exploded view of a plug-and-socket connector arrangement.

First of all, the construction of a plug-and-socket connector arrangement 3 according to the invention will be described with reference to FIG. 1. FIG. 1 shows a plug 1 which is arranged in a direction of insertion S opposite a mating plug 2. The plug 1 and mating plug 2 together form a plug-and-socket connector arrangement 3 according to the invention.

The plug 1 comprises a first plug-and-socket connector 5 which is inserted into a second plug-and-socket connector 4, and also a surrounding housing 6 which engages around the second plug-and-socket connector 4. The first plug-and-socket connector 5 thus forms an internal plug inserted into the second plug-and-socket connector 4.

The mating plug 2, which forms a pin socket, has a first mating connector 7 which is inserted into a second mating connector 9. The first mating connector 7 is arranged in a frame-like internal-plug receptacle 8. The internal-plug receptacle 8 is positioned inside the plug receptacle 2*a* which serves for receiving the plug 1. Coding elements 2*c*, 2*d*, 2*e* and 2*f* are arranged on the housing 2*b*, in the region of the plug receptacle 2*a*, which elements are designed complementarily to coding elements of the plug 1 and prevent incorrect alignment of the plug 1 and mating plug 2. Thus the coding elements 2*f* of the mating plug 2 which are designed as cutouts are formed complementarily to the coding elements if of the plug 1 which are designed as projections.

On the base of the substantially socket-shaped plug receptacle 2*a* which faces counter to a direction of insertion S, there are provided contact pins 10 which upon the joining of the plug-and-socket connector arrangement 3 penetrate into contact bushes, not shown here, of the plug 1. For receiving the contact bushes, the plug 1 has eight bush receptacles 4*a* on the second plug-and-socket connector 4, in which bush contacts with a substantially rectangular external profile can be received in positive manner.

A substantially rectangular internal-plug receptacle 11 of the second plug-and-socket connector 4 serves to receive the first plug-and-socket connector 5. The internal-plug receptacle 11 extends counter to the direction of insertion S in the form of a rectangular frame 11*a* away from the second plug-and-socket connector 4, so that the end face of the internal-plug receptacle 11 which faces counter to the direction of insertion S lies on a common plane with the end face of the surrounding housing 6 which faces counter to the direction of insertion S.

The second plug-and-socket connector 4 is received in a receiving shaft 6*c* of the surrounding housing 6. The receiving shaft 6*c* is formed by three inner walls of the surrounding housing 6, and is open on three sides. The surrounding housing 6 is thus substantially C-shaped and adjoins three outer surfaces of the first plug-and-socket connector which are at right-angles to one another.

After the joining of the plug 1, a latching means 12 of the surrounding housing 6 which is designed as a latch tab ensures a reliable connection between the plug 1 and the mating plug 2, in that latches (not shown here) arranged on the latching means 12 engage in mating latches 13 arranged on the mating plug 2. The latching means 12 designed as a latch tab can be deflected elastically substantially in the direction of the surrounding housing 6, and by its deflection permits the joining or loosening of a latch connection between the plug 1 and mating plug 2. A frame-like projection 6*h* formed by the surrounding housing 6, which extends away from the surrounding housing 6, prevents the latching means 12 from being unintentionally depressed by objects acting on the plug 1 from outside.

The internal plug-and-socket arrangement formed of the first plug-and-socket connector 5 and first mating connector 7 is designed for the transmission of signals or data, and may for example have the specifications of a Universal Serial Bus (USB). The first plug-and-socket connector 5 and the first mating connector 7 may be designed as a USB data connection and for example form a current USB interface of the wider, rectangular type A or of the smaller, almost square type B.

The first mating connector 7 is provided with two contact pins 7*a*, which upon the joining of the plug-and-socket connector arrangement 3 penetrate into the first plug-and-socket connector 5 and thus connect two conductors of a data-transmitting cable (not shown here) to a cable 14 which opens into the first plug-and-socket connector 5. An electromagnetic screen 7*b* reduces interference effects due to electromagnetic waves which might disrupt the signal or data transmission in the connection formed by the first plug-and-socket connector 5 and the first mating connector 7.

The screen 7*b* which acts as a coding element and the contact pins 7*a* of the first mating connector 7 form a first mating connector face 7*n*. The contact pins 10 and the coding elements 2*c*, 2*d*, 2*e* and 2*f* form a second mating connector face 9*a*. The first mating connector face 7*n* and the second mating connector face 9*a* jointly form a mating plug face F1.

Figure 2:
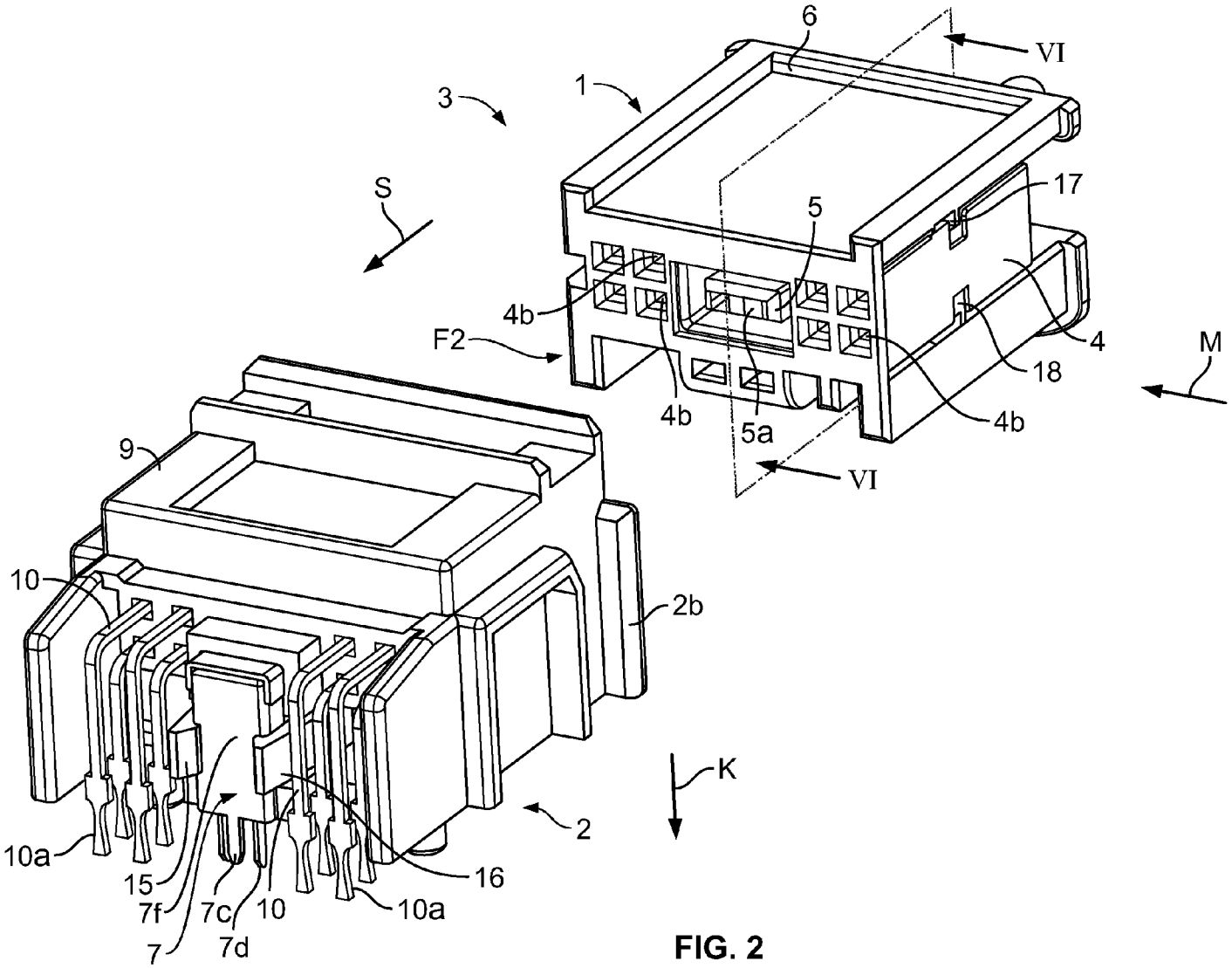
FIG. 2 shows a further diagrammatic exploded view of a plug-and-socket connector arrangement.

FIG. 2 is a diagrammatic perspective view of the plug-and-socket connector arrangement 3 in a direction of viewing opposite to the direction of viewing of FIG. 1. On the rear side of the mating plug 2, the contact pins 10 emerge from the housing 2*b* of the mating plug 2. The contact pins 10 initially extend in the direction of insertion S away from the housing 2*b* of the mating plug 2 and then substantially perpendicular to the direction of insertion S into a direction of contact K. Contacts arranged on the ends of the contact pins 10 facing perpendicular to the direction of insertion S are arranged in one plane. Thus the contacts 10*a*, when the mating plug 2 is fastened to a printed circuit board, are contacted therewith on a common plane.

The first mating connector 7 is held on the rear side of the mating plug 2 by two opposing latching means 15, 16, which engage around the first mating connector 7 in positive manner. A connection module 7*f* of the first mating connector 7, which comprises a contact 7*c* provided for the connection of the mating connector 7, is adapted in its length facing in the direction of contact K to the dimensions of the mating plug 2. Contacts 7*c*, 7*d* of the first mating connector 7 which extend in the direction of contact K are thus arranged approximately at the same height as the contacts 10*a* in the direction of contact K and consequently can be connected in electrically conductive manner together with the contacts 10*a* on one plane, for example on a printed circuit board.

The bush receptacles 4*a* shown in FIG. 1 open in the direction of insertion S into contact-pin receptacles 4*b*. Also the first plug-and-socket connector 5 arranged in the second plug-and-socket connector 4 is equipped with contact-pin receptacles 5*a* which together with the contact-pin receptacles 4*b* form the plug face of the plug 1.

The second plug-and-socket connector 4 is inserted into the surrounding housing 6 in an assembly direction M. Two securing members 17, 18 arranged on the inward-facing walls of the surrounding housing 6, which are designed substantially as bars extending in the assembly direction M, are inserted into grooves of the second plug-and-socket connector 4 which are designed for receiving the securing members 17, 18, and hold the second plug-and-socket connector in the surrounding housing 6 in and counter to the direction of insertion S.

Figure 3:
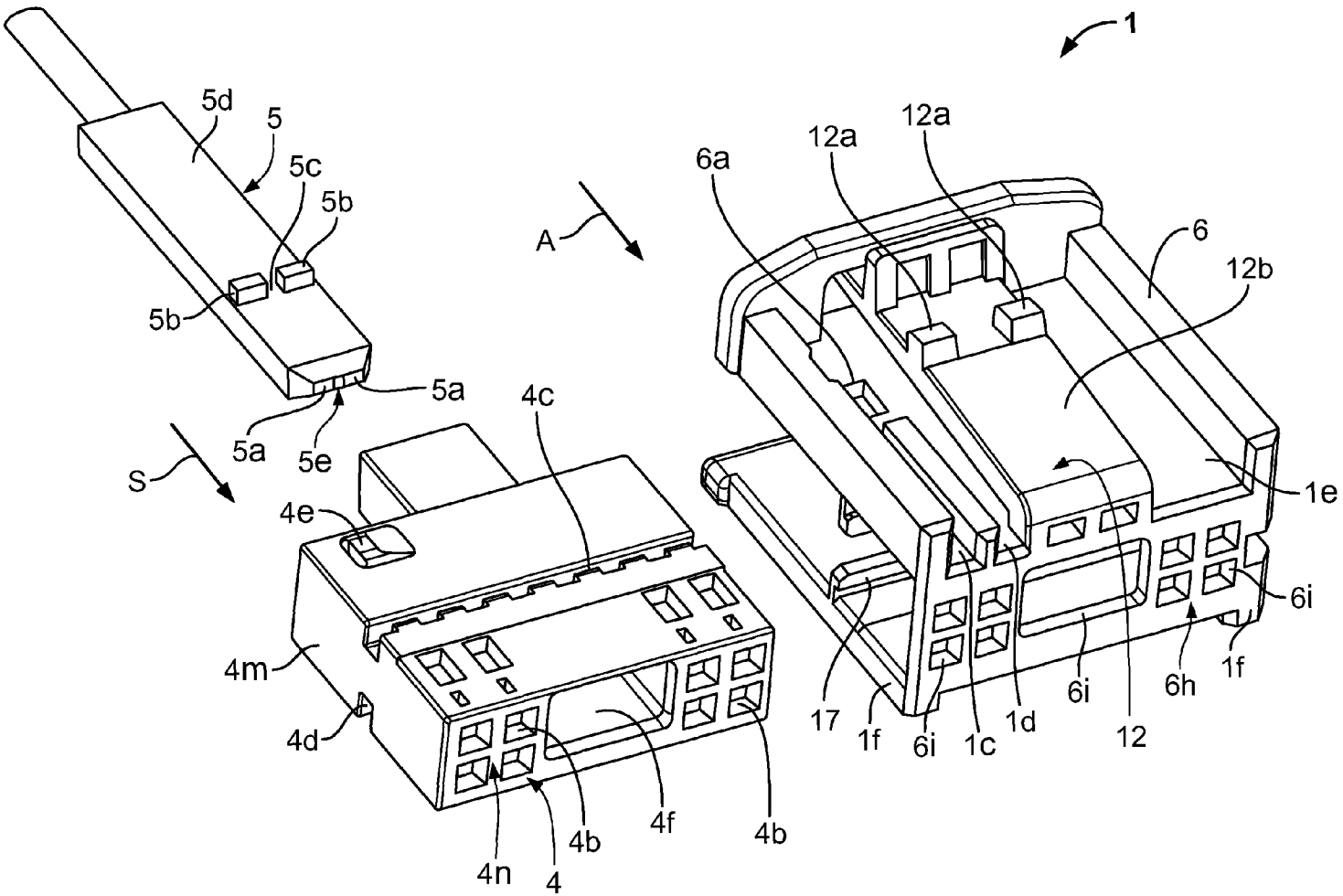
FIG. 3 shows a diagrammatic perspective exploded view of a plug 1.

FIG. 3 is a perspective exploded view of the plug 1. For receiving the securing members 17, 18 shown in FIG. 2 and FIG. 6, which are designed as bars, grooves 4*c*, 4*d* which extend transversely to the direction of insertion S over the entire width of the second plug-and-socket connector 4 are provided in the second plug-and-socket connector. The second plug-and-socket connector 4 or the housing 4*m* of the second plug-and-socket connector 4 is thus held in the surrounding housing 6 in a securing direction A, which in the example of embodiment illustrated corresponds to the direction of insertion S. In order to lock the second plug-and-socket connector 4 in the surrounding housing 6 after it has been inserted into the surrounding housing 6, a latch 4*e* designed as a latch projection is arranged on a side face of the second plug-and-socket connector 4, which latch, after the insertion of the second plug-and-socket connector 4 into the surrounding housing 6, engages in a mating latch 6*a* of the fixer housing 6 which is designed as an opening.

Contact-pin receptacles 4*b* designed as continuous openings serve to receive contacts of the mating plug 2, and form a second plug-and-socket connector face 4*n* which in the assembled state of the plug 1 is arranged parallel to a first plug-and-socket connector face 5*e* which comprises the contact-pin receptacles 5.

Coding elements in the form of projections if, cutouts or guides 1*c*, 1*d* and 1*e* are arranged on the surrounding housing 6. The coding elements 1*c*, 1*d*, 1*e* and 1*f* in the assembled state of the plug 1, together with the first plug-and-socket connector face 5*e* and the second plug-and-socket connector face 4*n*, form the plug face F2 shown in FIG. 2. A mask 6*j* formed by the surrounding housing 6 in the assembled state of the plug 1 is arranged in front of the plug-and-socket connector faces 4*n*, 5*e*, with cutouts 6*i* permitting the access of contact pins 7*a* and 10 to the associated contact-pin receptacles 4*b*, 5*a*. The mask 6*j* is thus part of the plug face F2.

In order to connect the first plug-and-socket connector 5 in positive manner to the second plug-and-socket connector 4 and/or the surrounding housing 6, holding members 5*b* designed as holding projections are provided on the first plug-and-socket connector 5, which when the plug 1 is assembled are positioned in the direction of insertion S behind the grooves 4*c*, 4*d* and are engaged behind by the securing members 17, 18 of the surrounding housing 6 counter to the direction of insertion S.

Latches 12*a* formed as latch projections are placed on the latch tab 12*b* on the surrounding housing 6, which latches, when the plug-and-socket connector arrangement is joined, engage in mating latches of the housing 2*b* of the mating plug 2 which are designed as recesses.

Figure 4:
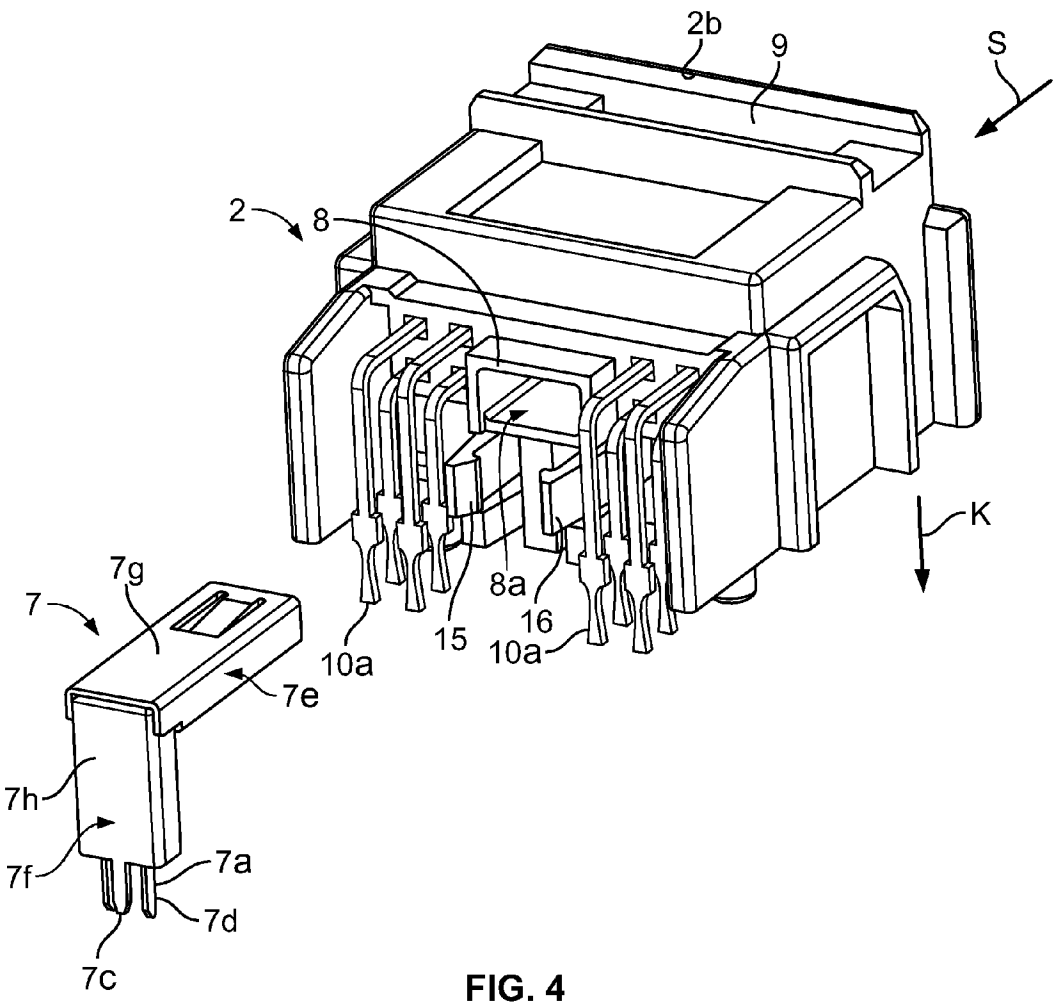
FIG. 4 shows a diagrammatic perspective exploded view of a mating plug 2.

FIG. 4 is a diagrammatic perspective exploded view of the mating plug 2. For receiving the first mating connector 7 in the internal-plug receptacle 8, the internal-plug receptacle 8 has a substantially rectangular duct 8*a*, which extends continuously from the rear side of the mating plug 2 up to the plug face thereof. The mating internal plug 7 has a receiving module 7*e* and a connection module 7*f* which are connected together via the contact pins 7*a*. The receiving module 7*e* and the connection module 7*f* of the first mating connector 5 are in addition each equipped with a screen 7*g*, 7*h*, the screens 7*g*, 7*h*, when the first mating connector 7 is assembled, forming an electromagnetic screen of the first mating connector 7. For connecting this screen to an earth conductor, a contact 7*c* is arranged on the screen 7*h* of the connection module 7*f*.

The first mating connector 7, for assembly of the mating plug 2, is pushed into the duct 8*a* and fixed by the latching means 15, 16. In so doing, the receiving module 7*e* of the first mating connector or the screen 7*g* is received virtually completely in the duct 8*a*, while the connection module 7*f* comes to lie between the latch means 15, 16. If the first mating connector 7 is inserted into the internal-plug receptacle 8, latch projections at the ends of the latching means 15, 16 which are designed as elastic tongues engage around the connection module 7*f*, so that the first mating connector 7 is held against displacement in the direction of insertion S.

Figure 5:
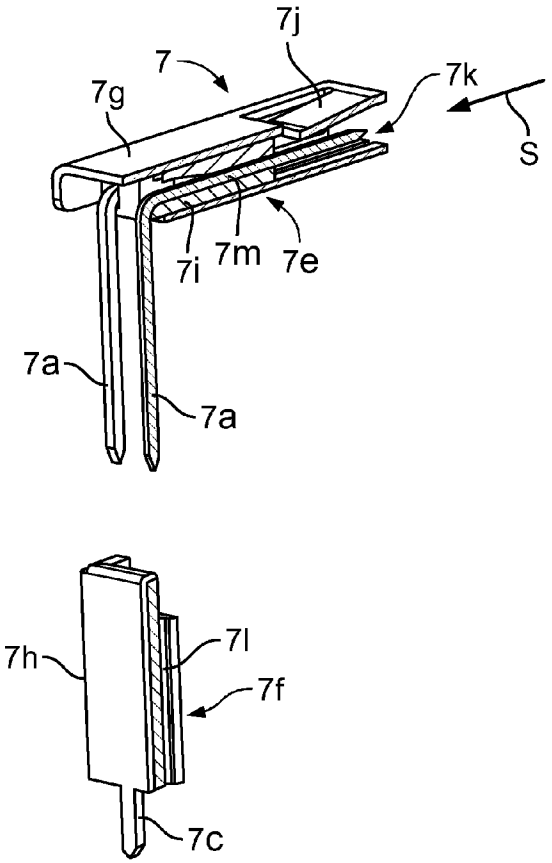
FIG. 5 shows a diagrammatic perspective exploded view of a first mating connector.

FIG. 5 shows a sectional view of the first mating connector 7 in an exploded view. The receiving module 7*e* comprises two contact pins 7*a* offered at right-angles, which are embedded in an insulating member 7*i*. The insulating member 7*i* for this has duct-shaped receptacles in which the contact pins 7*a* are held in a frictional, positive or material connection. The insulating member 7*i* is in turn received in the substantially box-shaped screen 7*g*, and connected thereto in a frictional, material or positive connection.

On its end facing counter to the direction of insertion S, the screen 7*g* is provided with a holding spring 7*j* which can be elastically deflected transversely to the direction of insertion S, and which when the plug-and-socket connector arrangement is assembled lies against the first plug-and-socket connector 5. The housing 5*d* of the first plug-and-socket connector 5 may also be surrounded by a electromagnetic screen which can be connected to the screen 7*g* in electrically conductive manner via the holding spring 7*j*.

The holding spring 7*j* is formed by the screen 7*g* and formed as a section which is cut out on three sides and curved in the direction of the contact pins 7*a*. At its end facing counter to the direction of insertion S, the holding spring 7*j* is connected to the screen 7*g*, so that the holding spring 7*j*, at least in the released state, tapers a receiving shaft 7*k* of the first mating connector 7 for receiving the first plug-and-socket connector 5 in the direction of insertion S.

Also the connection module 7*f* of the first mating connector 7 has an insulating member 7*l* which is surrounded by the screen 7*h*. Like the insulating member 7*i*, the insulating member 7*l* also has duct-shaped receptacles 7*m* in which the contact pins 7*a* can be received in sections. For connecting the receiving module 7*e* to the connection module 7*f* of the first mating connector 7, the sections of the contact pins 7*a* which extend transversely to the direction of insertion S may be inserted into the receptacles 7*m* of the connection module 7*f* until the electromagnetic screen 7*h* closes off with the electromagnetic screen 7*g* and forms a closed electromagnetic screen of the first mating connector 7. Once the connection module 7*f* has been placed on, this may be held preferably in a frictional connection on the contact pins 7*a*.

Different receiving modules 7*e* and connection modules 7*f* of the first mating connector may be provided in order to adapt the interface of the mating plug 2 which is formed by the contacts 7*c*, 7*d* and 10*a* of the mating plug 2 and which faces in the direction of contact K for contacting a printed circuit board in different configurations of the housing 2*b*. For example, a shortened or lengthened connection module 7*f* may be provided in an assembly for the production of a mating plug 2, the length of which module which faces in the direction of contact K in the assembled state is adapted to the height of the housing 2*b* extending in the direction of contact K.

Figure 6:
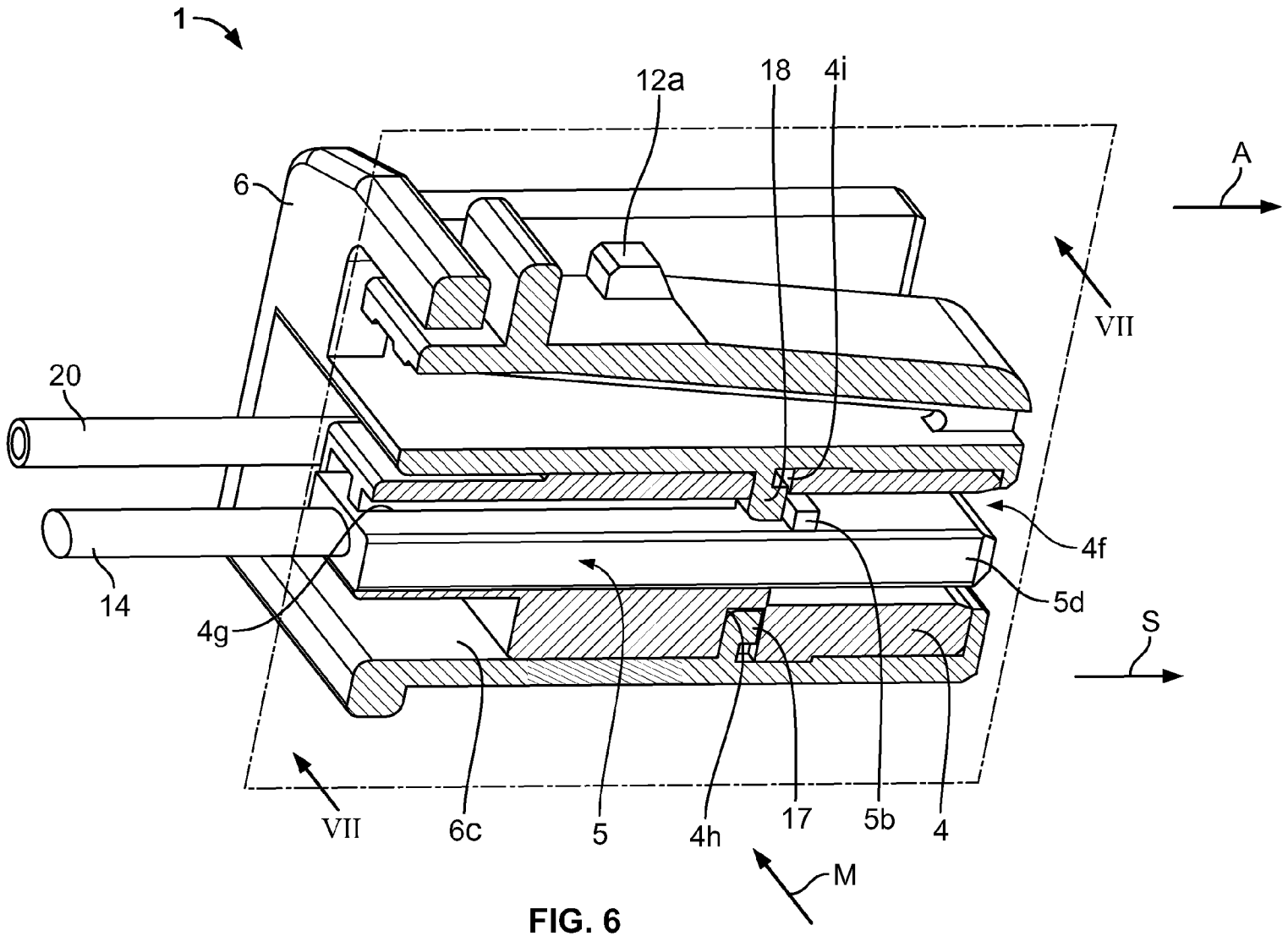
FIG. 6 shows a diagrammatic sectional view of the plug 1 in accordance with view VI of FIG. 2.

FIG. 6 is a sectional view of the plug 1 in the direction of viewing VI of FIG. 2. The first plug-and-socket connector 5 is inserted into the internal-plug receptacle 4*f*, the length of which which faces in the direction of insertion S corresponds approximately to the length of the housing 5*d* of the first plug-and-socket connector 5. A guide member 4*g*, which during the insertion of the first plug-and-socket connector 5 of the second plug-and-socket connector 4 is arranged in the guide member 5*c* which is formed by the holding members 5*b* and is designed as a guide groove, guides the first plug-and-socket connector 5 in the direction of insertion S.

The surrounding housing 6 has two securing members 17, 18 which are engaged in positive manner with the second plug-and-socket connector 4 and the first plug-and-socket connector 5 received in the second plug-and-socket connector 4. The first plug-and-socket connector 5 and the second plug-and-socket connector 4 are thus fixed relative to the surrounding housing 6 in the securing direction A.

After the assembly of the first plug-and-socket connector 5 in the second plug-and-socket connector 4, the second plug-and-socket connector 4 is inserted into the surrounding housing 6 in the assembly direction M. The securing member 17 formed by the surrounding housing 6 in this case engages in a cutout 4*h* in the second plug-and-socket connector 4, while the securing member 18 is introduced into an opening 4*i* in the second plug-and-socket connector 4. The securing member 18 in the assembled state of the plug 1 penetrates the second plug-and-socket connector 4 at the point of the slot-shaped opening 4*i*, and forms a stop which protrudes into the internal-plug receptacle 4*f*. When the plug 1 is assembled, the securing member 18 lies against a side of the holding members 5*b* which faces counter to the direction of insertion S. Thus the first plug-and-socket connector 5 is secured against displacement counter to the direction of insertion S with respect to the second plug-and-socket connector 4 and/or with respect to the surrounding housing 6. Particularly in the case of tensile forces which act counter to the direction of insertion S for example on the cable 14 which serves as a data or signal cable, the securing member 18 prevents slipping of the first plug-and-socket connector 5.

In order, upon assembly of the plug 1, to be able to align the positioning of the first plug-and-socket connector 5 in the internal-plug receptacle better relative to the position of the securing member 18, a stop may be provided in the internal-plug receptacle 4*f*. This stop may for example be designed as a projection of the second plug-and-socket connector 4 which projects into the internal-plug receptacle 4*f*, which connector in the position of the first plug-and-socket connector 5 shown in FIG. 6, i.e. in which the securing member 18 adjoins the holding member 5*b*, abuts against the holding member 5*b*.

Figure 7:
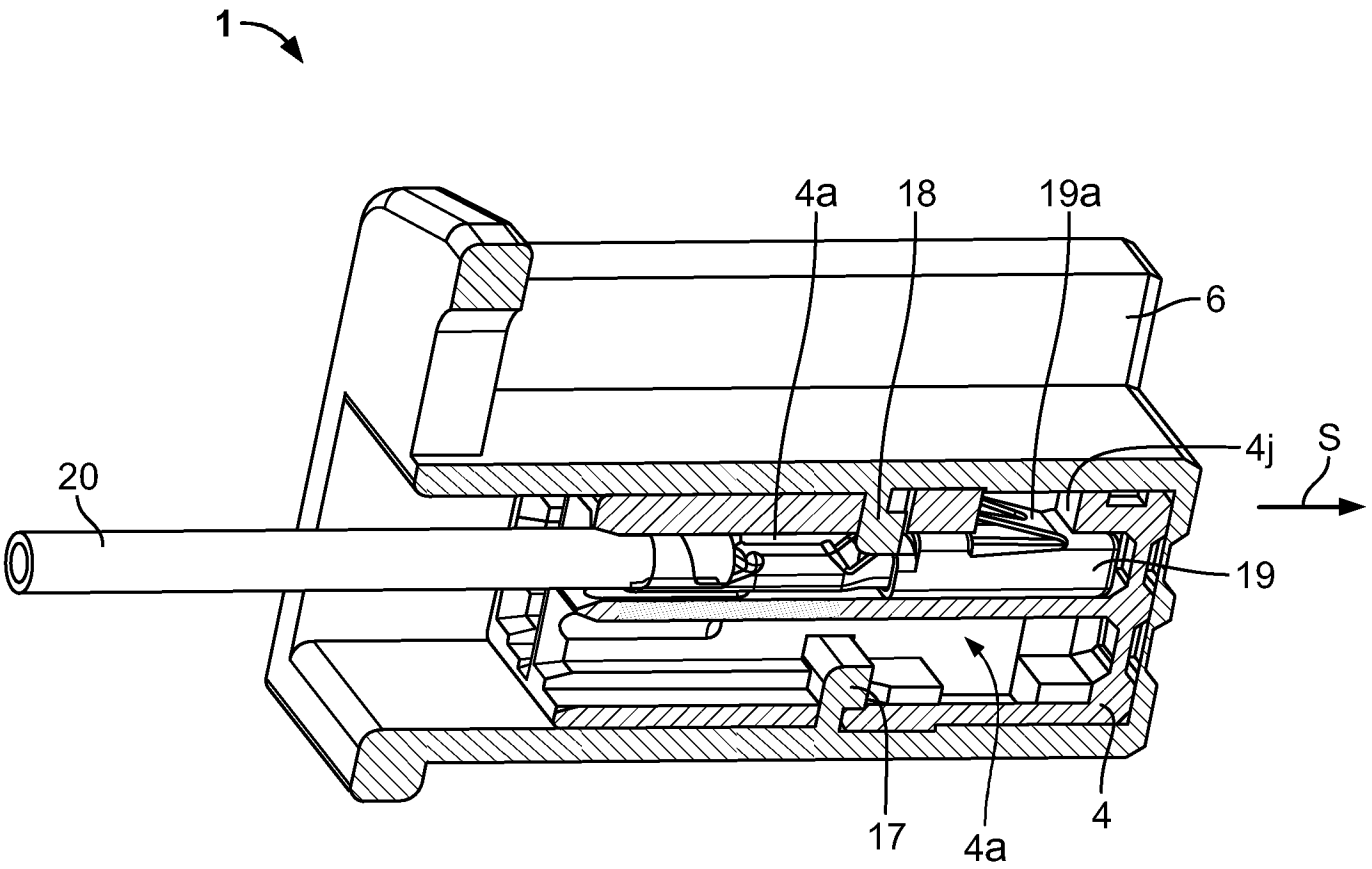
FIG. 7 shows a diagrammatic sectional view of the plug 1 in accordance with view VII of FIG. 6.

FIG. 7 is a sectional view of the plug 1 along the section plane shown in FIG. 6 in the direction of viewing VII. In the upper bush receptacle 4*a* there is received a contact bush 19, into which contact pins of the mating plug can be introduced. The contact bush 19, which is preferably made of sheet metal, has at its end facing in the direction of insertion S a substantially box-shaped structure, with a latch 19*a* being arranged on a side facing transversely to the direction of insertion S. The latch 19*a* engages in the illustrated assembled position of the contact bush 19 in the second plug-and-socket connector 4 into a mating latch 4*j* of the second plug-and-socket connector 4 which is designed as an opening.

At its end facing counter to the direction of insertion S, the contact bush 19 is connected via a crimp connection to a cable 20 which conducts electric current. In the event of a tensile force which acts on the cable 20, the contact bush 19 is held in the second plug-and-socket connector 4 via the latch 19*a*. Furthermore, the securing member 18 engages behind the contact bush 19 and, even if the latch 19*a* fails, prevents the contact bush 19 from slipping out of the second plug-and-socket connector 4.

Figure 8:
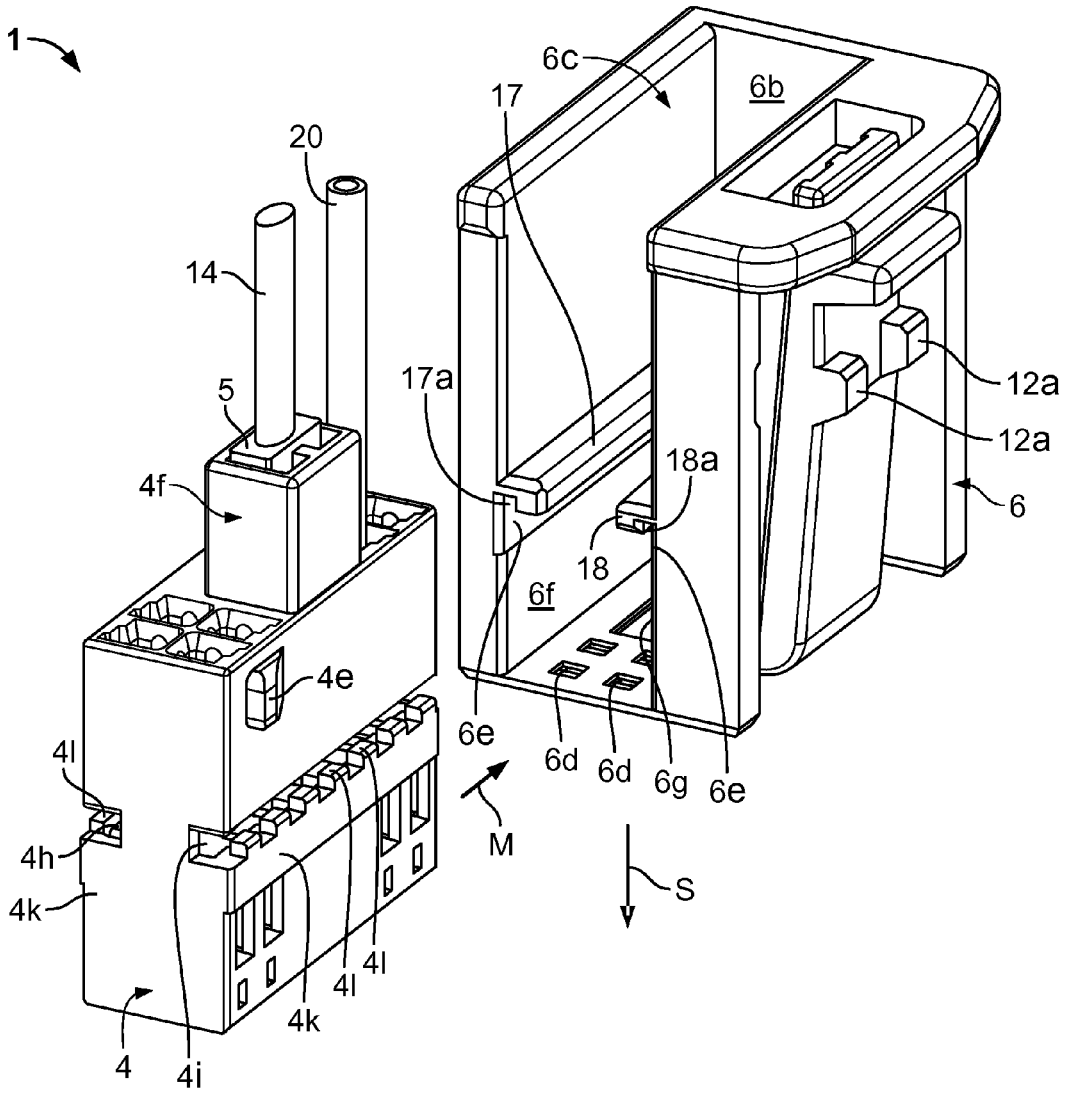
FIG. 8 shows a diagrammatic perspective view of the plug 1 in a preassembled position.

FIG. 8 is a diagrammatic perspective exploded view of the plug 1. Once the first plug-and-socket connector 5 has been assembled in the second plug-and-socket connector 4, the second plug-and-socket connector 4 is inserted into the surrounding housing 6 in the assembly direction M. The securing member 18 in this case passes into the opening 4*i* and the securing member 17 into the cutout 4*h* of the second plug-and-socket connector 4. An inward-facing housing wall 6*b* of the surrounding housing 6 serves as a positioning means which in the end position of the second plug-and-socket connector 4 lies against the second plug-and-socket connector 4 counter to the assembly direction M. In the assembled state of the plug 1, the second plug-and-socket connector 4 is completely received in the receiving shaft 6*c* of the surrounding housing 6, and contact-pin receptacles 6*b* of the surrounding housing are flush with the contact-pin receptacles 4*b* of the second plug-and-socket connector 4.

Guide members 6*e* in the housing 6 which are designed as guide grooves serve to receive guide members 4*k*, designed as guide projections, of the second plug-and-socket connector 4. The guide members 6*e* and 4*k* extend in the assembly direction M and in addition to guidance in the assembly direction M ensure fixing of the plug-and-socket connector 4 in the surrounding housing 6 in and counter to the direction of insertion S. Furthermore, prong-like projections 4*l* of the plug-and-socket connector 4 in the assembled state of the plug 1 engage in undercuts 17*a*, 18*a* in the securing members 17, 18 and thus permit a positive connection between the second plug-and-socket connector 4 and the side walls 6*f*, 6*g* of the surrounding housing 6. Thus it is ensured that the surrounding housing 6 cannot be loosened from the second plug-and-socket connector 4 due to thermal expansion or due to forces acting on the surrounding housing from the outside.

The housings 2*b*, 4*m*, 5*d* and 6 are preferably made from an electrically insulating material, in particular from plastics material. The screens 7*g*, 7*h* consist of an electrically conductive material, in particular metal, and may be produced from a punched-out metal sheet.

The invention claimed is:

1. A plug with a first plug-and-socket connector and at least a second plug-and-socket connector in which the first plug-and-socket connector is received, and with a surrounding housing in which the second plug-and-socket connector is received non-displaceably in at least one securing direction, the surrounding housing having a first securing member brought into engagement with both the second plug-and-socket connector and the first plug-and-socket connector, and by means of which the first and second plug-and-socket connectors can be fixed relative to the surrounding housing.

2. A plug according to claim 1, wherein the first plug-and-socket connector has a first plug-and-socket connector face and the second plug-and-socket connector has a second plug-and-socket connector face, the first plug-and-socket connector face and the second plug-and-socket connector face being parts of a common plug face.

3. A plug according to claim 1, wherein the securing member blocks a movement of one of the first and second plug-and-socket connectors in the surrounding housing.

4. A plug according to claim 1, wherein the securing member is designed as a positive-locking element which at least in the securing direction is designed to be able to be brought into engagement in positive manner both with the first plug-and-socket connector and the second plug-and-socket connector.

5. A plug according to claim 1, wherein the securing member penetrates, at least in sections, an internal-plug receptacle of the second plug-and-socket connector substantially transversely to the securing direction and spaced apart from a plug-and-socket connector face of the second plug-and-socket connector.

6. A plug with a first plug-and-socket connector and at least a second plug-and-socket connector in which the first plug-and-socket connector is received, and with a surrounding housing in which the second plug-and-socket connector is received non-displaceably in at least one securing direction, the surrounding housing having a securing member brought into engagement with both the second plug-and-socket connector and the first plug-and-socket connector, and by means of which the first and second plug-and-socket connectors can be fixed relative to the surrounding housing, wherein the at least one securing member is formed by a bar extending substantially transversely to the securing direction and projecting into a receiving shaft of the surrounding housing.

7. A plug according to claim 6, wherein the second plug-and-socket connector is designed to be able to be inserted into the receiving shaft of the surrounding housing in an assembly direction running substantially transversely to the securing direction.

8. A plug according to claim 7, wherein the securing member is designed to be able to be brought into engagement with the first plug-and-socket connector and with the second plug-and-socket connector in the assembly direction.

9. A plug according to claim 1, wherein the first plug-and-socket connector has a holding member which lies against the securing member counter to the securing direction.

10. A plug according to claim 1, wherein one of the first and second plug-and-socket connectors is provided with a guide member by means of which the one plug-and-socket connector can be guided in a direction of insertion into a final assembly position in which plug-and-socket connector faces of the first plug-and-socket connector and of the second plug-and-socket connector are flush with one another.

11. A plug according to claim 1, wherein the second plug-and-socket connector has a latching means by means of which it can be latched in the surrounding housing.

12. A mating plug for a plug according to claim 1, with a first mating connector and at least a second mating connector in which the first mating connector can be received, wherein the first mating connector is designed to be able to be constructed in modular fashion from a receiving module and a connection module.

13. A mating plug according to claim 12, wherein the receiving module and the connection module of the first mating connector in each case have an insulating member with at least one receiving shaft for receiving a contact pin, the receiving module and the connection module of the first mating connector can be connected together via at least one contact pin which can be received in the receiving shafts.

14. A mating plug according to claim 12, wherein the receiving module and the connection module each have an electromagnetic screen which adjoin each other in the assembled state of the first mating connector and form a closed electromagnetic screen of the first mating connector.

15. A plug-and-socket connector arrangement with at least one plug and at least one mating plug, wherein the mating plug is designed according to claim 12, and the plug comprises a first plug-and-socket connector and at least a second plug-and-socket connector in which the first plug-and-socket connector can be received, and with a surrounding housing in which the second plug-and-socket connector can be received non-displaceably in at least one securing direction, the surrounding housing having a securing member which is designed to be able to be brought into engagement with the second plug-and-socket connector and the first plug-and-socket connector received in the second plug-and-socket connector, and by means of which the first and second plug-and-socket connectors can be fixed relative to the surrounding housing.

16. A plug-and-socket connector arrangement according to claim 15, wherein the surrounding housing has a latching means by means of which the surrounding housing can be latched in the mating plug.

17. A plug with a first plug-and-socket connector and at least a second plug-and-socket connector in which the first plug-and-socket connector can be received, and with a surrounding housing in which the second plug-and-socket connector can be received non-displaceably in at least one securing direction, the surrounding housing having a securing member which is designed to be able to be brought into engagement with the second plug-and-socket connector and the first plug-and-socket connector received in the second plug-and-socket connector, and by means of which the first and second plug-and-socket connectors can be fixed relative to the surrounding housing, wherein the securing member is designed as a positive-locking element which at least in the securing direction is designed to be able to be brought into engagement in positive manner both with the first plug-and-socket connector and the second plug-and-socket connector.

18. A plug according to claim 17, wherein the first plug-and-socket connector has a first plug-and-socket connector face and the second plug-and-socket connector has a second plug-and-socket connector face, the first plug-and-socket connector face and the second plug-and-socket connector face being parts of a common plug face.

19. A plug according to claim 17, wherein the securing member blocks a movement of one of the first and second plug-and-socket connectors in the surrounding housing.

20. A plug according to claim 17, wherein the securing member penetrates, at least in sections, an internal-plug receptacle of the second plug-and-socket connector substantially transversely to the securing direction and spaced apart from a plug-and-socket connector face of the second plug-and-socket connector.

21. A plug with a first plug-and-socket connector and at least a second plug-and-socket connector in which the first plug-and-socket connector can be received, and with a surrounding housing in which the second plug-and-socket connector can be received in a receiving direction and non-displaceably in at least one securing direction, the surrounding housing having a securing member which is designed to be able to be brought into engagement with the second plug-and-socket connector and the first plug-and-socket connector received in the second plug-and-socket connector, and by means of which the first and second plug-and-socket connectors can be fixed relative to the surrounding housing, wherein the at least one securing member is formed by a bar extending substantially transversely to the securing direction, parallel to the receiving direction and projecting into a receiving shaft of the surrounding housing.

22. A plug according to claim 21, wherein the second plug-and-socket connector is designed to be able to be inserted into the receiving shaft of the surrounding housing in an assembly direction running substantially transversely to the securing direction.

23. A plug according to claim 22, wherein the securing member is designed to be able to be brought into engagement with the first plug-and-socket connector and with the second plug-and-socket connector in the assembly direction.

24. A plug with a first plug-and-socket connector and at least a second plug-and-socket connector in which the first plug-and-socket connector can be received, and with a surrounding housing in which the second plug-and-socket connector can be received non-displaceably in at least one securing direction, the surrounding housing having at least one securing member where the one securing member is designed to be able to be brought into engagement with both of the second plug-and-socket connector and the first plug-and-socket connector received in the second plug-and-socket connector, and by means of which the first and second plug-and-socket connectors can be fixed relative to the surrounding housing, wherein the first plug-and-socket connector has a holding member which lies against the securing member counter to the securing direction.

25. A plug according to claim 24, wherein one of the first and second plug-and-socket connectors is provided with a guide member by means of which the one plug-and-socket connector can be guided in the direction of insertion into a final assembly position in which plug-and-socket connector faces of the first plug-and-socket connector and of the second plug-and-socket connector are flush with one another.

26. A plug according to claim 24, wherein the second plug-and-socket connector has a latching means by means of which it can be latched in the surrounding housing.

27. A plug according to claim 1, wherein the surrounding housing further comprises a second securing member brought into engagement with both the second plug-and-socket connector and the first plug-and-socket connector, and by means of which the first and second plug-and-socket connectors can be fixed relative to the surrounding housing.

* * * * *